US007523924B2

(12) United States Patent
Melancon

(10) Patent No.: US 7,523,924 B2
(45) Date of Patent: Apr. 28, 2009

(54) DEVICES, SYSTEMS, AND METHODS FOR REINFORCING CONCRETE AND/OR ASPHALT CEMENT

(76) Inventor: Paul Melancon, 15655 Villoresi Way, Naples, FL (US) 34110

( * ) Notice: Subject to any disclaimer, the term of this patent is extended or adjusted under 35 U.S.C. 154(b) by 415 days.

(21) Appl. No.: 11/216,421

(22) Filed: Aug. 30, 2005

(65) Prior Publication Data

US 2007/0048493 A1 Mar. 1, 2007

(51) Int. Cl.
*F16F 1/06* (2006.01)

(52) U.S. Cl. ..... 267/166; 52/649.1; 428/113

(58) Field of Classification Search ..... 267/166, 267/166.1, 167; 52/740.1, 740.2, 740.3, 52/740.4, 740.6, 309.1, 309.15, 309.17, 396.02, 52/649.1, 694; 428/113, 377, 397
See application file for complete search history.

(56) References Cited

U.S. PATENT DOCUMENTS

| | | | | |
|---|---|---|---|---|
| 790,230 | A | 5/1905 | Stempel | |
| 4,260,143 | A | 4/1981 | Kliger | |
| 4,475,723 | A | 10/1984 | Meyer | |
| 4,536,429 | A | 8/1985 | Mercer | |
| 4,617,219 | A | 10/1986 | Schupack | |
| 4,867,423 | A * | 9/1989 | Marsh | 267/91 |
| 4,910,076 | A | 3/1990 | Ando et al. | |
| 5,025,605 | A | 6/1991 | Sekijima et al. | |
| 5,314,268 | A | 5/1994 | Calandra, Jr. et al. | |
| 5,338,605 | A | 8/1994 | Noland et al. | |
| 5,763,043 | A | 6/1998 | Porter et al. | |
| 5,836,715 | A | 11/1998 | Hendrix et al. | |
| 6,068,250 | A | 5/2000 | Hawkins et al. | |
| 6,149,143 | A * | 11/2000 | Richmond et al. | 267/92 |
| 6,183,835 | B1 | 2/2001 | Cho et al. | |
| 6,250,030 | B1 | 6/2001 | Sugimoto et al. | |
| 6,612,085 | B2 | 9/2003 | Edwards et al. | |
| 2002/0190451 | A1 | 12/2002 | Sancaktar et al. | |
| 2003/0110733 | A1 | 6/2003 | Grace et al. | |

OTHER PUBLICATIONS

Mechanical Springs A.M. Wahl, McGraw-Hill Book Company, C 1963, Chapters: 7,9,10,12,14,18,21,27.
www.lightweight-structures.com (click "others" in the menu to the right of the page, click "design and manufacture of a spring using composite materials".
International Search Report dated Feb. 13, 2008.

* cited by examiner

*Primary Examiner*—Pam Rodriguez
(74) *Attorney, Agent, or Firm*—Edwards Angell Palmer & Dodge LLP

(57) ABSTRACT

Devices and systems for reinforcing a construction medium, which is generally of some finite length, width, and depth. In a preferred embodiment, the device comprises one or more linear reinforcing coils that can be of any desired length and dimension in combination with one or more vertical load carrying coils. Preferably, the linear reinforcing coils comprise a plurality of coil wires that have been braided or interwoven with a strand of synthetic fiber. More preferably, the linear reinforcing coils and the vertical load carrying coils include one or more load transfer tabs disposed along all or some portion of the length of each.

30 Claims, 10 Drawing Sheets

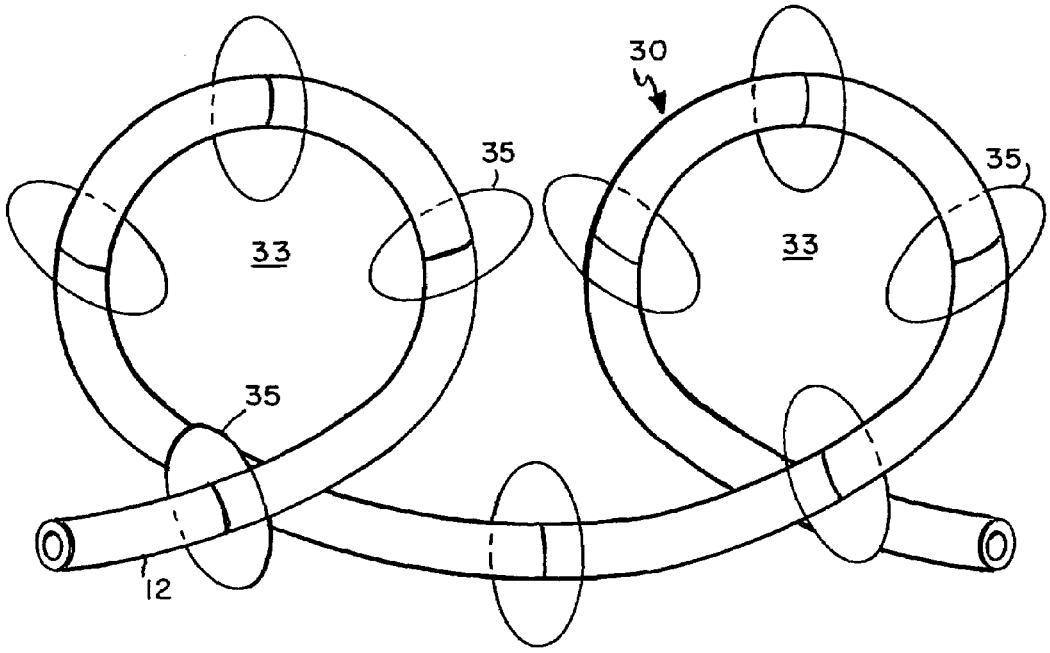
FIG. 3
FIG. 4A
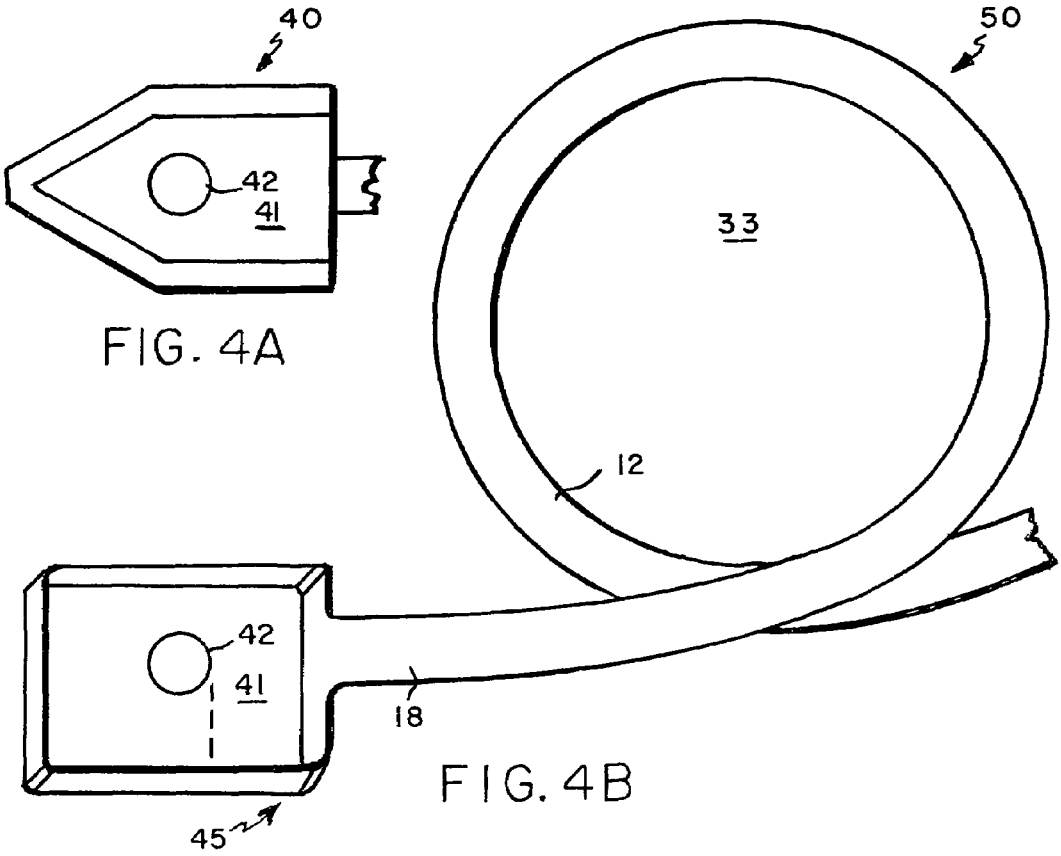
FIG. 4B

DEVICES, SYSTEMS, AND METHODS FOR REINFORCING CONCRETE AND/OR ASPHALT CEMENT

BACKGROUND OF THE INVENTION

1. Field of the Invention

This invention relates to devices, systems, and methods for reinforcing construction materials and, more particularly, to devices, systems, and methods for reinforcing concrete and/or asphalt cement, in which the devices, systems, and methods include metallic or non-metallic coil wires that can include a plurality of metallic or non-metallic load transfer tabs distributed thereon.

2. Background of the Related Art

Throughout most of the United States, roadways, typically, are made of rigid concrete slabs or a more flexible pavement such as asphalt cement or a combination of the two. When design loads necessitate, concrete pavements are steel-reinforced to provide tensile strength to the concrete, which has an inherently high compressive strength but, relatively, a very low tensile strength. Traditional steel reinforcement, especially for concrete, assures ductile failure of the concrete prior to a catastrophic failure of the steel. Although a "ductile-failure assured" mode of failure is more important when dealing with concrete beams and columns for which catastrophic failure of the steel could result in loss of life and severe damage, the design concept or mode of failure is equally applicable to design of transportation structures like roadways.

Traditionally, tensile reinforcement for concrete structures, e.g., roadway pavements, structural slabs or the like, is provided using one or more levels of steel reinforcing bars ("rebar"). Optionally, when minimal tensile reinforcement is needed, welded-wire fabric ("WWF") can be used to provide some tensile strength, but, more preferably to provide reinforcement against shrinking or cracking that may result from temperature changes.

The placement of steel reinforcement, whether as WWF or rebar, is a complex procedure made even more so by having to raise the bulky WWF or rebar a vertical distance—typically about three inches or more—above grade elevation, to ensure adequate cover to protect the rebar or WWF from the ill effects of water and oxidation. This often entails using stirrups or some other readily available construction or scrap material to elevate the rebar or WWF. This is far from a perfect solution, however.

Furthermore, notwithstanding over-design and over-reinforcement, rebar and WWF as reinforcement media still do not prevent tension cracking of the concrete or asphalt cement, which, typically, first, occurs in the cover area between the rebar or WWF and grade. Tensile cracking can lead to progressive failure of the concrete system, which manifests as unsightly and annoying ruts, potholes or the like.

Asphalt cement, a specifically engineered blend or mixture of a bituminous bi-product and aggregates, is typically used for flexible pavement design. Flexible pavements are normally cheaper to build and maintain than reinforced concrete slabs. However, by their very flexible nature, they can deteriorate and fail more rapidly than concrete roadways.

A common—if not the most common—failure mode of flexible pavements is by reflective tension cracking. Compressive forces at the roadway surface are transmitted through the flexible pavement and applied to the prepared subsoil, base course material or previous roadway on which the new pavement was constructed. This load can cause the subsoil or base course to compress. When the subsoil or base course compresses, the overlying flexible pavement is placed in tension, causing tensile cracks in the bottom portion of the asphalt cement matrix. With time and repeated loading, the tensile cracks can make their way to the roadway surface, i.e., "daylight", and, progressive failure of an asphalt cement system results. This, too, manifests as ruts, potholes or the like.

Others have proposed various methods, systems, and devices for reinforcing flexible pavements. For example, plastic materials, e.g., geo-grids and geo-textiles, and woven and non-woven overlay fabrics have been provided between the interface between the new asphalt cement roadway and any previous subsurface, whether a natural soil or a previous pavement. Steel is impractical because asphalt cement structures are generally porous and therefore prone to water infiltration that can oxidize or corrode the steel.

Encasing steel in an epoxy coating to guard against corrosion is a possible solution. However, "modern" construction techniques cannot guarantee the integrity of the epoxy coating during or after installation. Coating rebar also adds additional cost, which escalates the cost of constructing a horizontal roadway that covers hundreds of miles. Reinforcing bars made of a fiberglass composite and/or using nail- or pin-size steel, nylon or fiberglass fibers to reinforce the concrete have also been proposed and used with some success. However, concrete admixtures are prone to clumping and uneven distribution throughout the concrete or asphalt cement substrate.

Therefore, it would be desirable to provide devices, systems, and methods for reinforcing a construction medium, e.g., concrete, asphalt cement, and the like economically, to minimize tensile failure of the medium that occurs when WWF and/or rebar are used.

SUMMARY OF THE INVENTION

In a first embodiment, the present invention provides a device for reinforcing a construction medium, which is generally of some finite length, width, and depth. Preferably, the device comprises one or more linear reinforcing coils that can be of any desired length and dimension include one or more load transfer tabs disposed along thereof. More preferably, the one or more linear reinforcing coils are disposed at one or more elevations throughout the depth of the construction medium.

In one aspect of the first embodiment, each of the one or more linear reinforcing coils comprises a plurality of strands of a coil wire, which can be solid or hollow core, interwoven or braided with one or more strands of a fibrous material. Preferably, the metallic or non-metallic coil wire is a hollow-core coil wire and the fiber material is selected from the group consisting of carbon fibers, meso-pitch carbon fibers, fiberglass fibers, polyethylene fibers, aramid fibers, and mixtures thereof. More preferably, the coil wire is manufactured of titanium, although, any suitable metal or alloy can be employed.

In another aspect of the first embodiment, the device further comprises a plurality of vertical load carrying coils that are structured and arranged between linear reinforcing coils when there are multiple levels of linear reinforcing coils in the construction medium to provide additional reinforcement between the multiple levels of linear reinforcing coils. Preferably, each of the plurality of vertical load carrying coils also can include one or more load transfer tabs that are disposed along the length of the vertical load carrying coils.

In yet another aspect of the first embodiment, the shape of the load transfer tabs can be selected from the group consisting of a square, a rectangle, a diamond, a circle, an oval, an ellipse, a triangle, a parallelogram, a trapezoid, and combinations thereof.

In still another aspect of the first embodiment, the construction medium is selected from the group consisting of concrete, asphalt cement, gunite, shotcrete, earth slopes, earth embankments, a rock wall of a shaft or tunnel, and combinations thereof.

In a second embodiment, the present invention provides a system for reinforcing a construction medium. Preferably, the system comprises one or more linear reinforcing coils, one or more of which has one or more load transfer tabs disposed along the length thereof; and a plurality of vertical load carrying coils that are structured and arranged between the multi-level linear reinforcing coils to provide additional reinforcement between the linear reinforcing coils.

In one aspect of the second embodiment, each of the one or more linear reinforcing coils comprises a plurality of strands of coil wire, which can be solid or hollow-core, interwoven or braided with one or more strands of a fibrous material. Preferably, the coil wire is a metallic or non-metallic hollow-core spring wire and the fibrous material is selected from the group consisting of carbon fibers, meso-pitch carbon fibers, fiberglass fibers, polyethylene fibers, and aramid fibers, combinations thereof. More preferably, the coil wire is manufactured of titanium, although, any suitable metal or alloy can be employed.

In another aspect of the second embodiment, each of the plurality of vertical load carrying coils also can include one or more load transfer tabs that are disposed along the length thereof. Preferably, the shape of the load transfer tabs is selected from the group consisting of a square, a rectangle, a diamond, a circle, an oval, an ellipse, a triangle, a parallelogram, a trapezoid, and combinations thereof.

In still another aspect of the first embodiment, the construction medium is selected from the group consisting of concrete, asphalt cement, gunite, shotcrete, earth slopes, earth embankments, a rock wall of a shaft or tunnel, and combinations thereof.

In a third embodiment, the present invention provides a system for reinforcing a rock tunnel face. Preferably, the system comprises a plurality of linear reinforcing coils, one or more of which can include one or more load transfer tabs disposed along a length thereof; and an anchor plate for anchoring the plurality of linear reinforcing coils to the rock tunnel face. Preferably, the linear reinforcing coils are disposed at discrete locations of known or suspected rock movement to reinforce the rock tunnel face and minimize rock movement. More preferably, each of the plurality of vertical load carrying coils can include one or more load transfer tabs that are disposed along the length thereof.

In one aspect of the third embodiment, each of the one or more linear reinforcing coils comprises a plurality of strands of a solid or hollow-core coil wire, interwoven or braided with one or more strands of a fibrous material. Preferably, the coil wire is a metallic or non-metallic, hollow-core spring wire and the fibrous material is selected from the group consisting of carbon fibers, meso-pitch carbon fibers, fiberglass fibers, polyethylene fibers, aramid fibers, and mixtures thereof. More preferably, the coil wire is manufactured of titanium although; any suitable metal or alloy can be employed.

In another aspect of the third embodiment, the shape of the load transfer tabs is selected from the group consisting of a square, a rectangle, a diamond, a circle, an oval, an ellipse, a triangle, a parallelogram, a trapezoid, and combinations thereof.

In a fourth embodiment, the present invention provides a method of reinforcing a construction medium, the method comprising the steps of providing one or more linear reinforcing coils, which can have one or more load transfer tabs disposed along the length thereof;

disposing said coils at discrete levels throughout the depth of the construction medium to provide multiple levels of reinforcement;

providing a plurality of vertical load carrying coils that are disposed between the multi-level linear reinforcing coils to provide additional reinforcement between the linear reinforcing coils; and interweaving the plurality of vertical load carrying coils about the multiple levels of linear reinforcing coils.

BRIEF DESCRIPTION OF THE DRAWINGS

The invention will be better understood by reference to the following more detailed description and accompanying drawings where like reference numbers refer to like parts:

FIG. 3 is an illustrative embodiment of two loops of a linear reinforcing coil in accordance with the present invention;

FIGS. 4A and 4B are illustrative embodiments of tab end anchors in accordance with the present invention;

DETAILED DESCRIPTION OF THE INVENTION INCLUDING PREFERRED EMBODIMENTS

Figure 10:
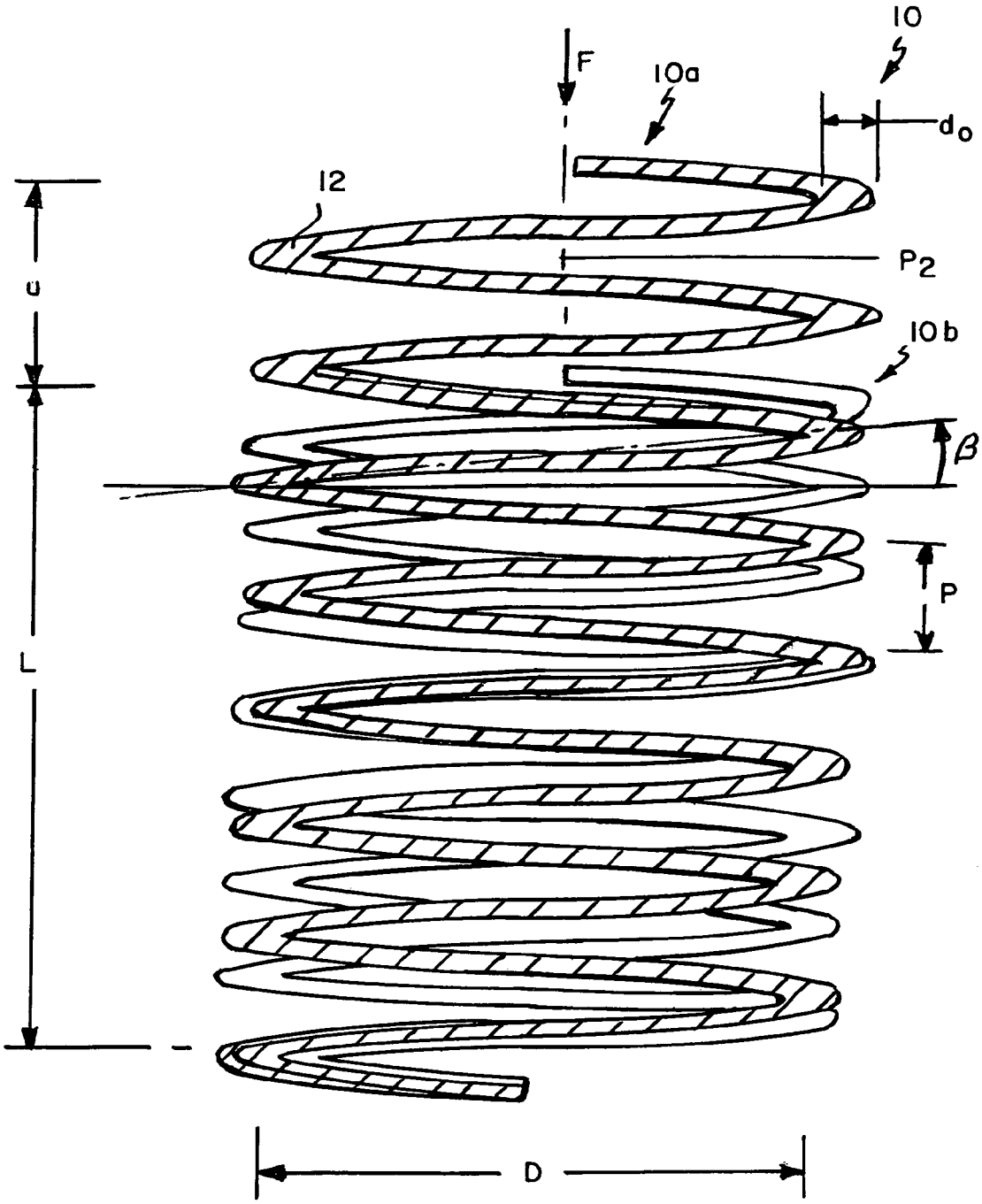
FIG. 10 is an illustrative embodiment of a helical coil.

Referring to FIG. 10, the theory of coils will be described briefly. In FIG. 10, there is shown a helical coil 10, e.g., a spring, in an uncompressed state 10*a* and a compressed state 10*b*. The helical coil 10 includes a plurality of coils 12 that define a total length L and a diameter D. Each of the plurality of coils 12 has an outer diameter $d_0$ and a pitch P (distance) between adjacent coils 12.

According to spring theory, the spring rate R of a helical coil 10 is given by the following equation:

$$R = \frac{F}{u} = \frac{4GJ_t}{N_a \pi D^3} \quad [1]$$

where F is the force applied to produce a deflection or deflection u; G is the shear modulus of the coil; $J_t$ is a torsion moment of inertia; $N_a$ is the number of active coils; and D is the diameter of the coil measured from mid diameter $d_0/2$ to mid-diameter $d_0/2$.

Figure 2:
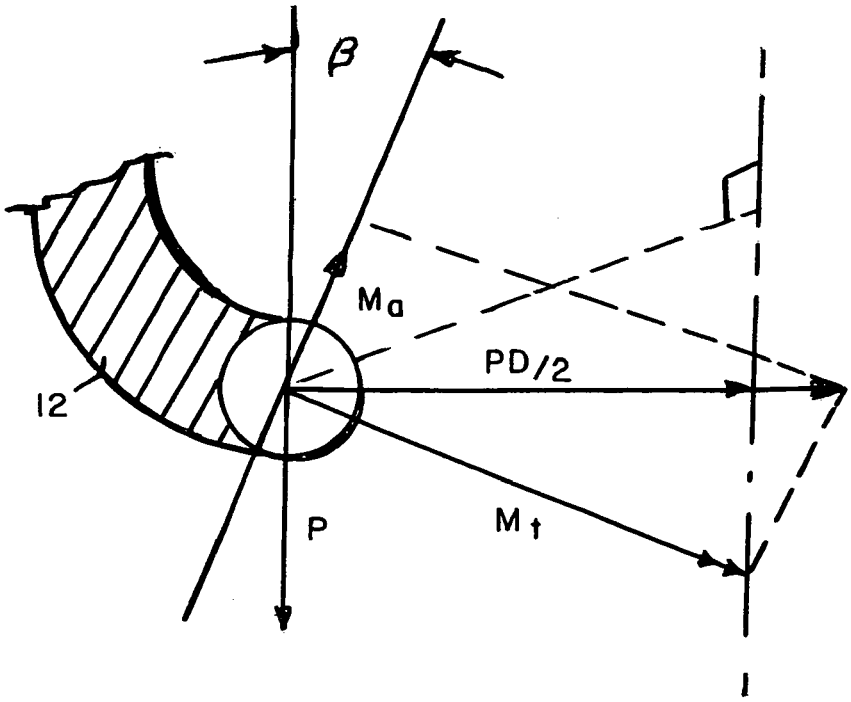
FIG. 2 is an illustrative embodiment of moments and forces on a single coil of a helical coil.
Figure 5A:
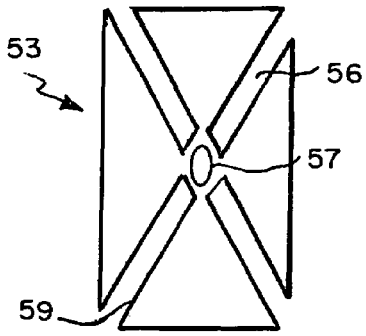
FIGS. 5A to 5E are illustrative embodiments of load transfer tabs in accordance with the present invention.
Figure 5B:
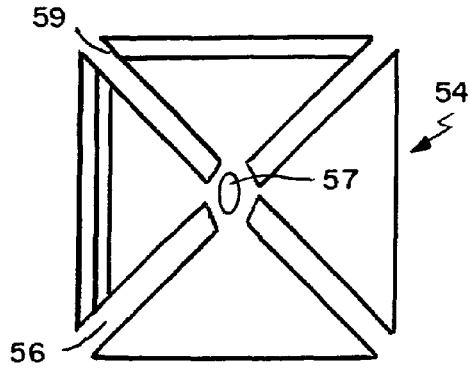
Figure 5C:
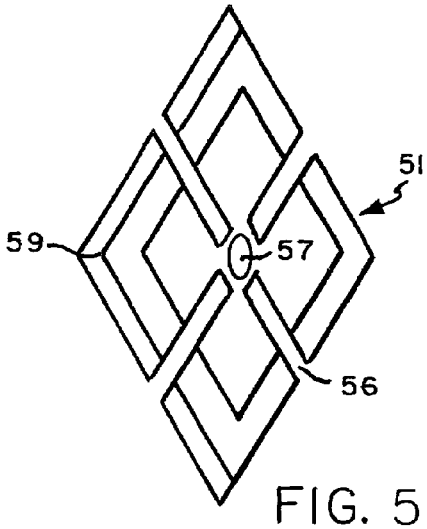
Figure 5D:
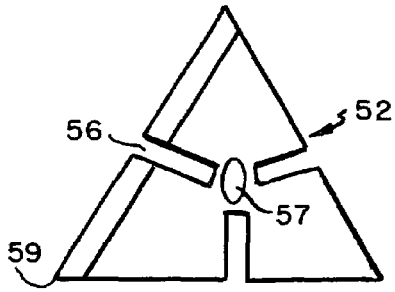
Figure 5E:
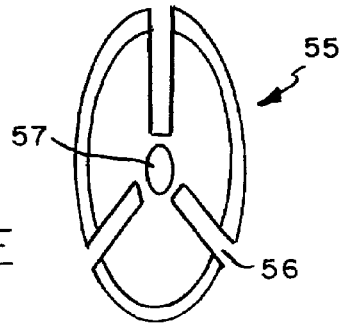

Referring to FIG. 2, the bending (σ) stress and shear (τ) stress in a single coil 12 are given by the following equations, respectively:

$$\sigma = \frac{M_\delta \cdot d_0}{I_\delta \cdot 2} = \frac{[F \cdot (D/2) \cdot \sin\beta] \cdot d_0}{I_\delta \cdot 2} \quad [2]$$

$$\tau = \frac{M_t \cdot d_0}{J_t \cdot 2} = \frac{[F \cdot (D/2) \cdot \cos\beta] \cdot d_0}{J_t \cdot 2} \quad [3]$$

where $M_\delta$ is the moment; $I_\delta$ is the moment of inertia ($=\pi d_0^4/64$); $J_t$ is the torsion moment of inertia ($=\pi d_0^4/32$); and β is an angle of rotation.

The bending and shear stress equations [2] and [3] demonstrate that the spring stiffness is dependent on the outer diameter of the coil $d_0$. Accordingly, coil sections, especially hollow core sections, can provide greater stiffness as a function of weight, which is to say, greater weight effectiveness. Advantageously, hollow core reinforcement can be more effective than solid core reinforcement, e.g., steel reinforcing bars.

Rewriting the moment of inertia equations for a hollow core coil and substituting the results in equations [2] and [3], the stresses are now given by the equations:

$$\sigma = \frac{M_\delta \cdot d_0}{I_\delta \cdot 2} = \frac{16 \cdot F \cdot D \cdot d_0}{\pi(d_o^4 - d_i^4)} \cdot \sin\beta \quad [4]$$

$$\tau = \frac{M_t \cdot d_0}{J_t \cdot 2} = \frac{8 \cdot F \cdot D \cdot d_0}{\pi(d_o^4 - d_i^4)} \cdot \cos\beta \quad [5]$$

Figure 1A:
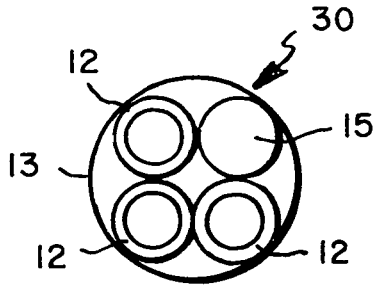
FIGS. 1A and 1B provide illustrative embodiments of a reinforcing device in accordance with the present invention.
Figure 1B:
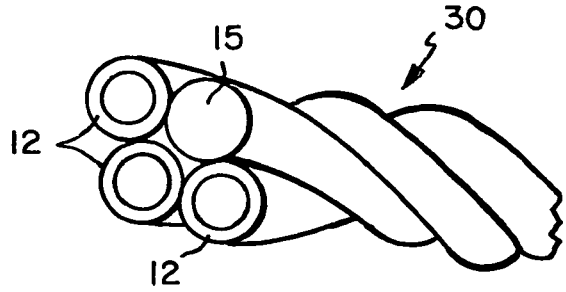

Referring now to FIGS. 1A, 1B, and 3, devices, systems, and methods for providing tensile reinforcement to construction materials, especially concrete and asphalt cement, will now be described. In the context of this disclosure and to simplify the description of the invention, reference will be made to construction materials comprising concrete or asphalt cement. This, however, is not to be construed as an attempt by the inventor to restrict application of the reinforcing devices and reinforcing systems to concrete or asphalt cement applications. On the contrary, those of ordinary skill in the art will appreciate that the reinforcing devices and reinforcing systems described herein can also be used as reinforcement in connection with the application of gunite or shotcrete, e.g., for soil slope reinforcement, i.e., soil nailing, soil stabilization, tunnel wall reinforcement, and the like.

In FIGS. 1A, 1B, and 3, there is shown a coil wire 12 of a linear reinforcing coil 30 in accordance with a first embodiment of the present invention. In a preferred embodiment, the linear reinforcing coil 30 is made of a plurality of metallic or non-metallic coil wires 12 that have been interwoven or, more preferably, braided with one or more strands of a synthetic fiber 15. In one aspect of the present invention, the coil wires 12 provide reinforcing strength to the construction medium along with synthetics to prevent tensile failure. The plurality of coil wires 12 can be solid or, more preferably, hollow-core, metallic or non-metallic springs and, most preferably, the plurality of coil wires 12 are pre-tensioned metal or metal alloys, e.g., corrosion resistant steel, stainless steel, titanium, and the like.

Although the preferred embodiment includes metallic coil wires 12, the invention is not to be construed as being limited thereto. Indeed, the invention can be practiced using non-metallic coil wires 12, e.g., coil wires 12 made of synthetic fibers, impregnated resins, and mixtures thereof. Furthermore, although the preferred embodiment includes one or more strands of a synthetic fiber 15, the invention is not to be construed as being limited thereto. For example, instead of interweaving or braiding one or more strands of a synthetic fiber 15 with the coil wires 12, the coil wires 12 can be interwoven or braided and then encased in a sheath 13.

In a preferred embodiment, each strand of hollow-core coil wire 12 is cold drawn or in-line forged, annealed and/or heat treated/shot peened, and pre-tensioned in manners that are well known to the art. The coil wires 12, e.g., three strands of hollow-core coil wire 12, are then woven, e.g., braided, with one or more synthetic fiber strands 15. The synthetic fiber strands 15 can be selected from the group consisting of carbon fibers (e.g., meso-pitch carbon fibers), fiberglass fibers (e.g., alkali resistant fiberglass fibers), ultra-high molecular weight polyethylene (e.g., SPECTRA® fibers manufactured by Honeywell of Colonial Heights, Va.), aramid fibers (e.g., TWARON® fibers manufactured by Teijin Twaron of the Netherlands), and the like. Preferably, the finished coils of the woven system 30 are further pre-tensioned to set the synthetic fibers 15. More preferably, the finished coils 30 are stretched or extended to about 100 percent of their original, pre-stretch length.

Preferably, during the weaving/braiding process, an excess amount of, or additional, synthetic material 41 from the synthetic fibers 15 is provided at the distal end (not shown) and proximal end 18 of the wound coil of wire 50. Referring to FIGS. 4A and 4B, excess synthetic material 41 can be fashioned, e.g., using a heated die, into end tab anchors 40 and 45 for attaching the linear reinforcing system 30 to, e.g., a mechanical anchoring device. For illustrative purposes only, end tab anchor 40 is shown having a substantially pentagonal shape and end tab anchor 45 is shown having a substantially rectangular shape. Any practical shape can be used as an end tab anchor. Optionally, an anchoring bore 42 can be provided in the end tab anchors 40 and 45. Preferably, the bore 42 has a diameter of between about ⅜-inch and about ¾-inch or sufficient diameter to allow a mechanical anchoring device to pass through the bore 42.

Advantageously, as shown in FIG. 3, one or more load transfer tabs 35 can be provided along all or some portion of the length of one or more coil wires 12 of the linear reinforcing coil 30. Although, in a preferred embodiment, only one of the coil wires 12 of the plurality of linear reinforcing coils 30 includes load transfer tabs 35, that is not to say that some or all of the other coil wires 12 cannot also include load transfer tabs 35.

Having described a linear reinforcing coil 30, load transfer tabs 35 will now be described. The purpose of the load transfer tabs 35 is to provide more or additional area for greater distribution of loads throughout more of the concrete and/or asphalt cement matrix. More specifically, the load transfer tabs 35 provide greater transfer of loads in the vertical and horizontal plane. Conventional reinforcement of, for example, reinforced concrete slabs, can include one or maybe two levels of WWF or rebar, depending on the thickness of the slab, design loads, etc. The concrete disposed between the upper and lower reinforcement layers, however, does not complement the steel reinforcement as it could. The load transfer tabs 35 make more efficient use of this inter-reinforcement concrete region.

The load transfer tabs 35 can be disposed along the length of the coil wires 12 at uniform or non-uniform spacing. Increasing the density of the load transfer tabs 35 will increase the loads that can be carried, but it will also increase the cost. Moreover, if the load transfer tabs 35 are structured and arranged too densely on the coil wires 12, the likelihood of concrete voids occurring between load transfer tabs 35 and coil loops 33 as the concrete is being placed is enhanced.

Preferably, the load transfer tabs 35 are integral, which is to say, are made a part of the coil wire 12. Those of ordinary skill in the art realize that during in-line forging operations, the coil wire 12 can be mechanically altered, e.g., crimped or otherwise tooled, at discrete locations to provide a load transfer tab 35. Alternatively, load transfer tabs 35 can be attached to the coil wires 12, e.g., by welding. However, this method is less preferred because of the additional expense of manufacture.

Referring to FIGS. 5A to 5E, there are shown illustrative embodiments of various removable load transfer tab 35 shapes. Each of the load transfer tabs 35 includes a center opening 57 that is structured and arranged to provide a tight interference fit with a coil wire 12.

The shape of the load transfer tabs 35 can be varied for specific purposes. Typically, diamond-shaped 51, triangular-shaped 52, rectangular-shaped 53, and square-shaped 54 load transfer tabs 35 are better suited for earth retention, earth reinforcement, and asphalt reinforcement applications because the sharp or pointed edges 59 provide a more suitable interface with the construction medium. On the other hand, circular-, oval-, and elliptical-shaped 55 load transfer tabs 35 are better suited for application with concrete. The size and shape of the load transfer tabs 35, however, can be adapted to accommodate the design loads and local construction conditions.

Figure 11A:
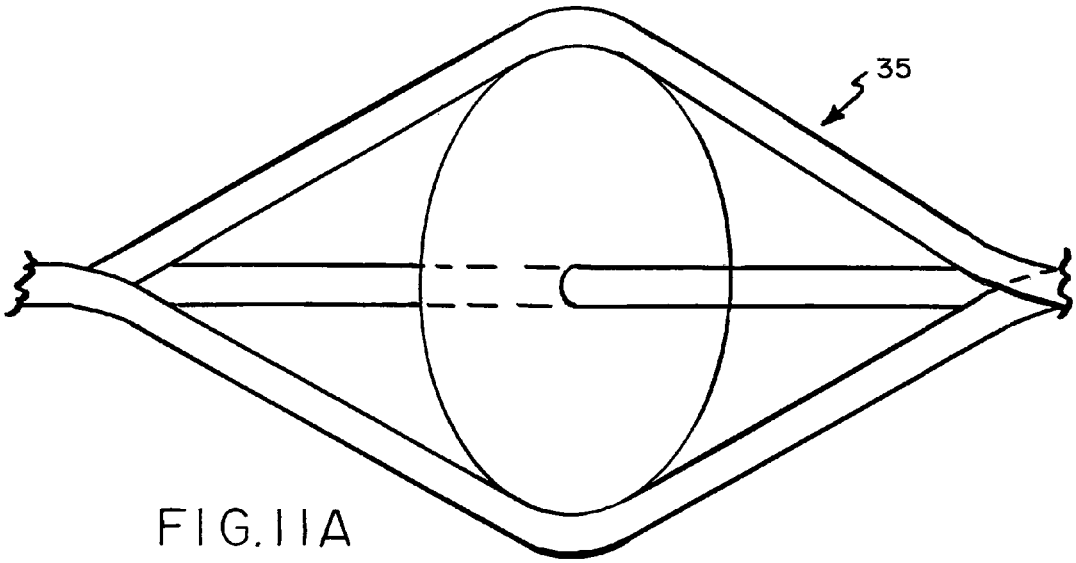
FIGS. 11A and 11B are illustrative embodiments of load transfer tabs without and with notches in accordance with the present invention.
Figure 11B:
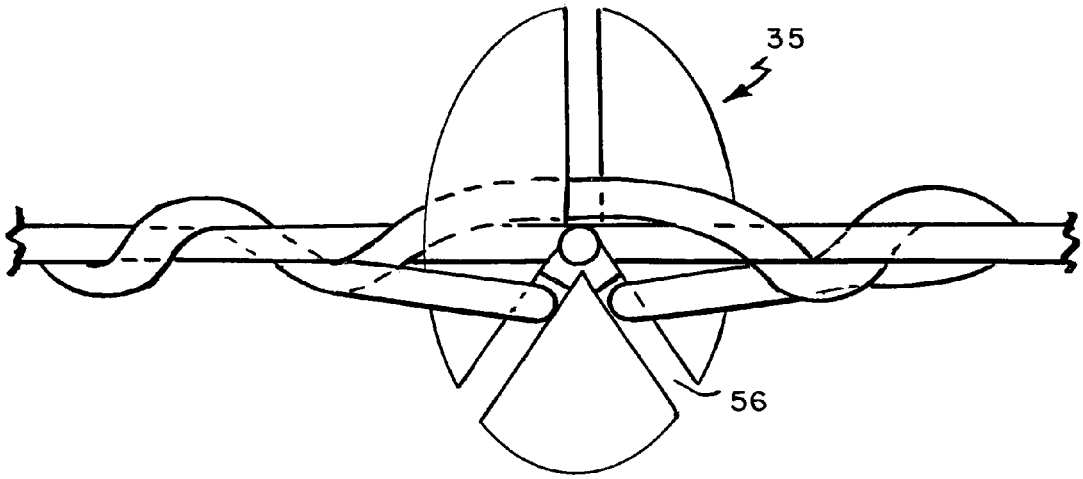

Optionally, a plurality of notches 56 can be included in the load transfer tabs 35. Referring to FIGS. 11A and 11B, respectively, a load transfer tab 35 without notches 56 and a load transfer tab 35 with notches 56 are shown. With the latter, during the braiding or winding process, the synthetic fiber 15 and/or other coil wires 12 enter the notches 56, which allows the synthetic fiber 15 and/or coil wires 12 to be braided or wound closer and more tightly to the coil wire 12 having the transfer tabs 35. This results in a more effective and prominent shape. In contrast, load transfer tabs 35 without notches 56 result in the tabs 35 losing their shape and effectiveness.

Notches 56 can be provided during the forging of the load transfer tabs 35 or, alternatively, can be mechanically added, e.g., by stamping, cutting, and the like. The notches 56 can extend to within a few millimeters of the center opening 57 or be farther away as desired. The number of notches 56 on each load transfer tab 35 can vary and depends on the shape of the load transfer tab 35 and the number of synthetic fiber 15 and/or other coil wires 12 in the linear reinforcing coil 30. Typically, three or four notches 56 are sufficient but the invention is not to be construed as being so limited.

Figure 6:
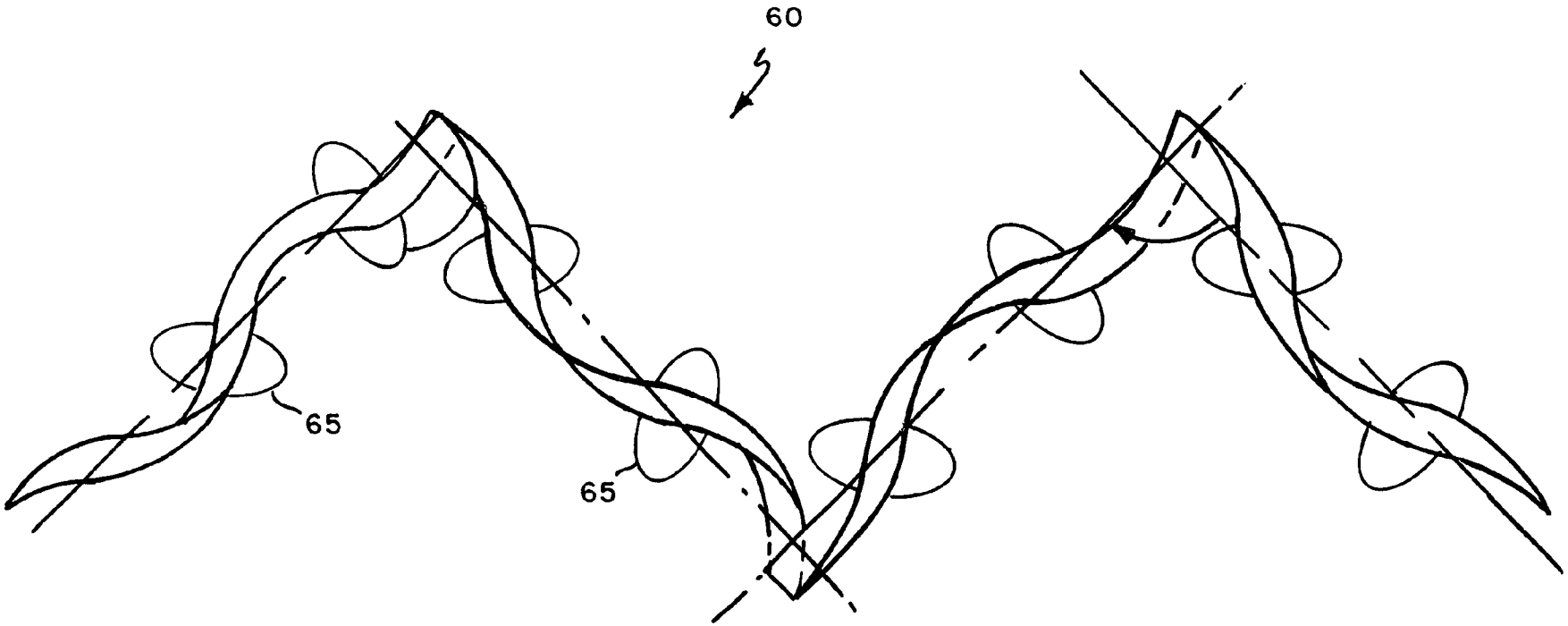
FIG. 6 is an illustrative embodiment of a vertical load carrying coil in accordance with the present invention.
Figure 12:
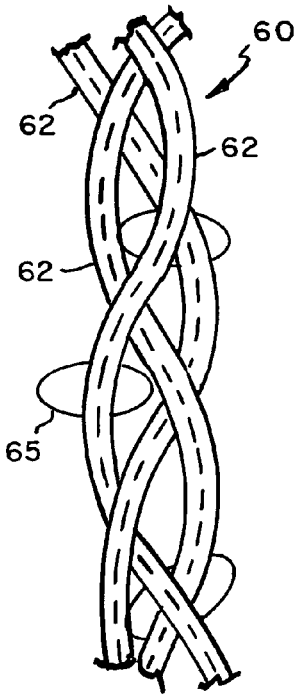
FIG. 12 is an illustrative embodiment of a the braiding of three coil portions of the vertical load carrying coil in accordance with the present invention.

Having described a linear reinforcing coil 30, another aspect of the reinforcement system will now be described. Referring to FIGS. 6 and 12, a vertical-load carrying coil 60 is shown. Preferably, the vertical-load carrying coil 60 is structured and arranged to provide, in conjunction with the linear reinforcing coil 30, additional load carrying capability. More preferably, the vertical-load carrying coil 60 is structured and arranged to provide additional load carrying capability by distributing loads vertically through the area between reinforcement levels.

Preferably each vertical-load carrying coil 60 comprises a plurality of coil portions 62 that can vary in size and width depending on the design loading. More preferably, one or more of the vertical-load carrying coils 60 includes a plurality of load transfer tabs 65. The purpose of the load transfer tabs 65 is to provide more area for greater distribution of loads throughout the concrete and/or asphalt cement. The load transfer tabs 65 can be provided at uniform or non-uniform spacing. Increasing the density of the load transfer tabs 65 will increase the load that can be carried, but it will also increase the cost. Moreover, if the load transfer tabs 65 are structured and arranged too densely on the vertical-load carrying coil 60, the likelihood that concrete voids may occur between load transfer tabs 65 and, for example, the coil loops 33 of the linear reinforcing coil 30 as the concrete is being placed is enhanced.

Figure 13A:
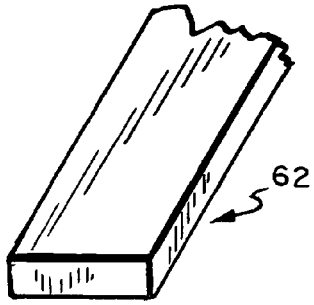
FIGS. 13A TO 13C are illustrative embodiments of coil portion cross sections in accordance with the present invention.
Figure 13B:
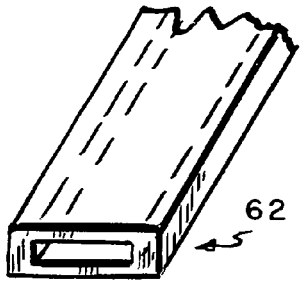
Figure 13C:
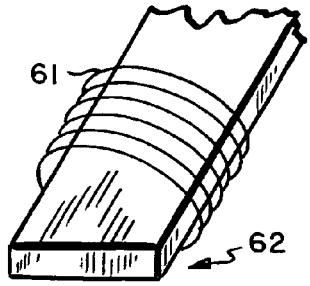

In one aspect of the vertical-load carrying coil 60, the coil 60 comprises three flat or substantially flat metal coil portions 62. A flat or substantially flat cross section is preferred because the cross section provides a wider footprint to carry more load in the vertical direction. Referring to FIGS. 13A to 13C, there are shown three embodiments of a coil portion 62. FIG. 13A shows a solid core, substantially rectangular shaped coil portion 62; FIG. 13B shows a hollow, rectangular shaped coil portion 62; and FIG. 13C shows a solid core, rectangular shaped coil portion 60 having a plurality of coil windings 61 that can be disposed at discrete locations along the entire length of the coil portion 60.

Preferably, the flat or substantially flat coil portions 62 are made of titanium. More preferably, each coil portion 62 is cold-drawn or in line forged, annealed, heat-treated, shot-peened, and/or pre-tensioned. However, although, the present invention is being described using three coil portions 62 of titanium metal, the invention is not to be construed to be limited thereto. For example, more or fewer coil portions 62 can be used, which are all covered by this disclosure. Moreover, the coil portions 62 can be made of other metals or alloys and non-metallic materials as well.

Preferably, the coil portions 62 are structured and arranged similar to a leaf coil system, which is well known to the art. More preferably, the plurality of coil portions 62 is woven or braided as shown in FIG. 12, to provide a helical configuration.

In a preferred embodiment, load transfer tabs 65 can be disposed along the length of the coil portions 62 at uniform or non-uniform spacing. Load transfer tabs 65 can be attached to the coil portions 62, e.g., by welding, or each load transfer tabs 65 can include a center opening that is structured and arranged to provide a tight interference fit with a coil portion 62. Increasing the density of the load transfer tabs 65 will increase the loads that can be carried, but it will also increase the cost.

Referring to FIGS. 5A to 5E, there are shown illustrative embodiments of various removable load transfer tab shapes that can also be used in connection with coil portions 62. The shape of the load transfer tabs can be varied for specific purposes. Typically, diamond-shaped 51, triangular-shaped 52, rectangular-shaped 53, and square-shaped 54 load transfer tabs are better suited for earth retention, earth reinforcement, and asphalt reinforcement applications because the sharp or pointed edges 59 provide a more suitable interface with the construction medium. On the other hand, circular-, oval-, and elliptical-shaped 55 load transfer tabs are better suited for application with concrete. The size and shape of the load transfer tabs, however, can be adapted to accommodate the design loads and local construction conditions. Optionally, a plurality of notches 56 can be included in the load transfer tabs 65 as previously described.

Figure 7:
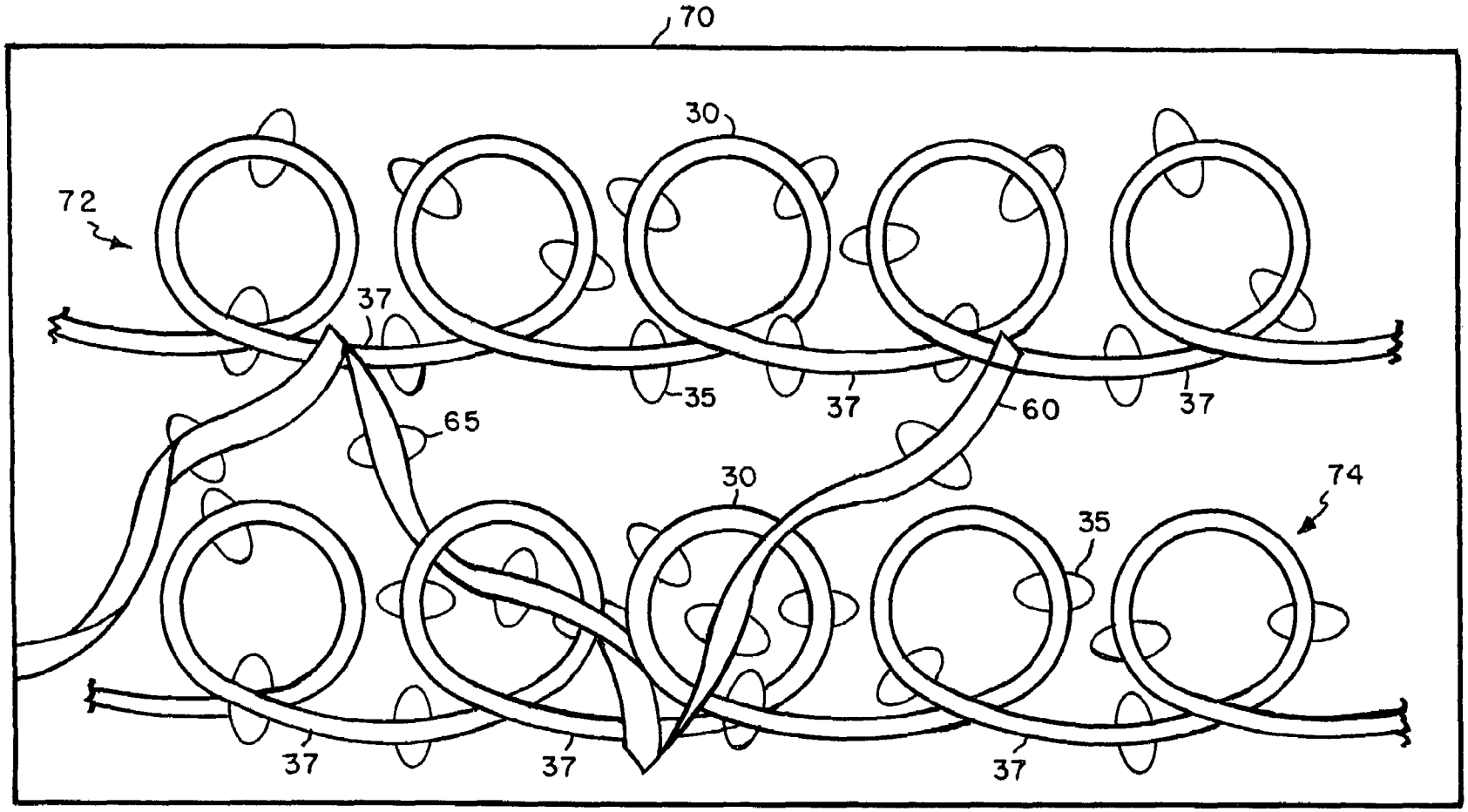
FIG. 7 is a side, sectional view of an illustrative embodiment of a reinforcing scheme comprising two levels of linear reinforcing coils in combination with a vertical load carrying coil.
Figure 14:
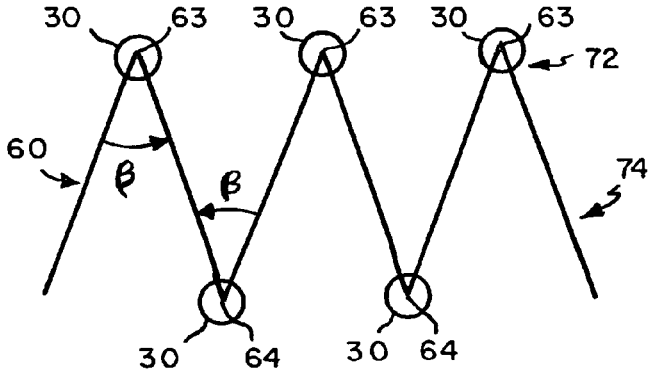
FIG. 14 is a diagrammatic of a reinforcing scheme heaving linear reinforcing coils disposed at each peak and trough of the vertical load carrying coil.

An exemplary use of the vertical-load carrying coil 60 with respect to the linear reinforcing coil 30 is shown in FIGS. 7 and 14. FIG. 7 depicts a sectional, side view of a structural (concrete) slab 70. FIG. 14 depicts an illustrative embodiment of a reinforcing scheme.

Preferably, the vertical-load carrying coil 60 is shaped like a triangular sinusoid, providing a plurality of peaks 63 and troughs 64. Those or ordinary skill in the art will appreciate that equations [2], [3], [4], and [5] are at a maximum when the angle $\beta$ is at or near 45 degrees so that the sine and cosine approach unity. Accordingly, the reinforcement $\beta$ angle between adjacent peaks and adjacent troughs should be at or near 45 degrees.

In a preferred embodiment, the structural slab 70 includes an upper reinforcement level 72 and a lower reinforcement level 74. Preferably, the upper reinforcement level 72 and the lower reinforcement level 74 comprise linear reinforcing coils 30 having a plurality of load transfer tabs 35 thereon. As shown in FIG. 14, the linear reinforcing coils 30 can be disposed on all or some of the peaks 63 at the upper reinforcement level 72 and on all or some of the troughs 64 at the lower reinforcement level 74. The troughs 64 are disposed at grade.

More preferably, a vertical-load carrying coil 60 is structured and arranged, e.g., interlaced or interwoven, between the upper reinforcement level 72 and the lower reinforcement level 74. For example, as shown in FIG. 7, the vertical-load carrying coil 60 is disposed about non-loop portions 37 of the linear reinforcing coils 30 in the upper reinforcement level 72 and the lower reinforcement level 74. The load transfer tabs 35 and 65 better distribute the load to the concrete matrix and, more importantly, distribute the load to more of the concrete matrix, e.g., the concrete. Alternatively, ties (not shown), e.g., wire ties, synthetic ties, and the like, can be used to attach linear reinforcing coils 30 at the peaks 63 or troughs 64 of the vertical-load carrying coil 60.

Figure 8:
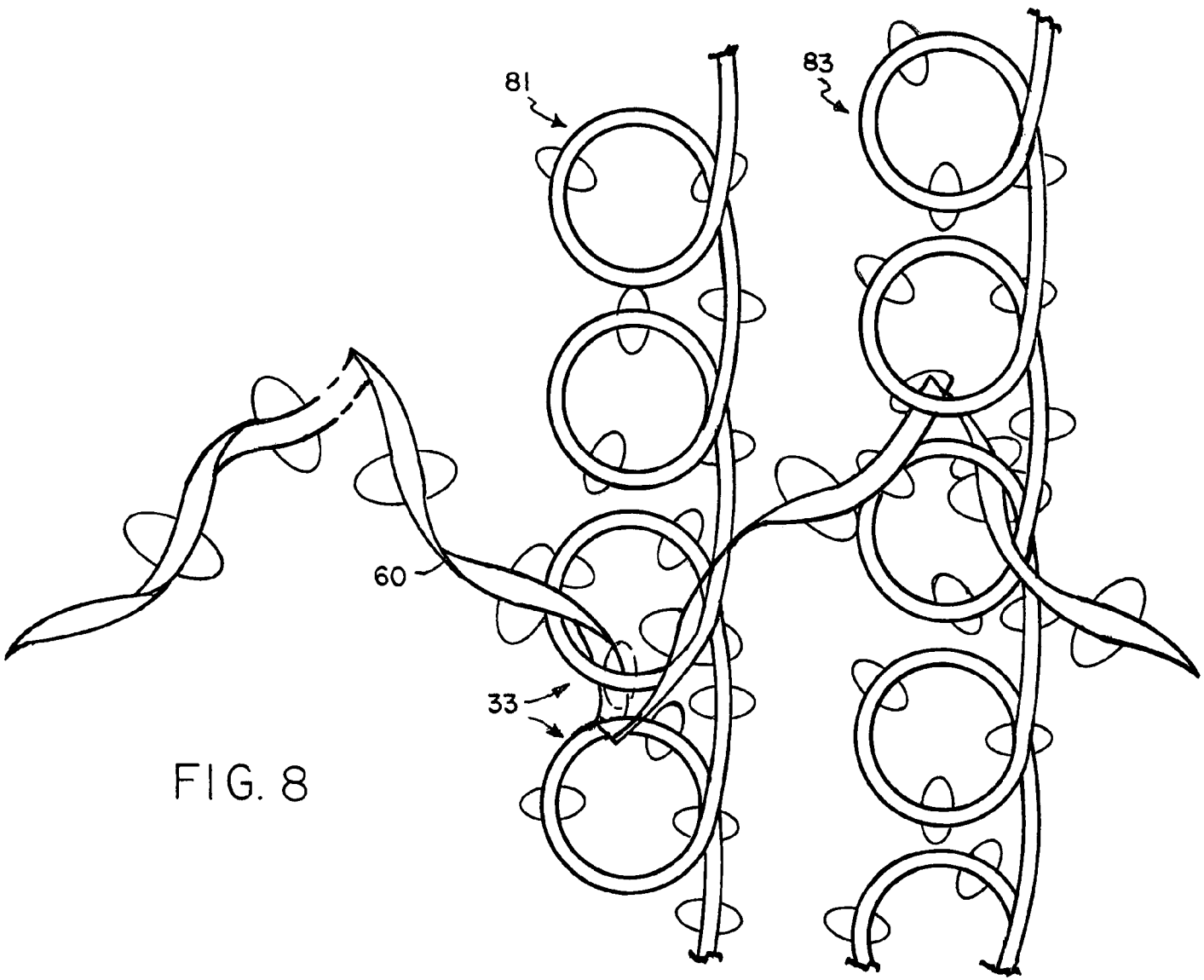
FIG. 8 is a partial plan view of an illustrative embodiment of a reinforcing scheme comprising two levels of linear reinforcing coils in combination with a vertical load carrying coil.

FIG. 8 depicts a plan view of an alternative use of the reinforcing system. Specifically, FIG. 8 provides first and second reinforcement rows 81 and 83 of linear reinforcing coils 30 that, preferably, could be structured and arranged in a staggered arrangement in which adjacent reinforcement rows are parallel to but at different elevations within the slab 70. A vertical-load carrying coil 60 is structured and arranged, e.g., interlaced, interwoven or braided, between the first and second reinforcement rows 81 and 83. For example, as shown in FIG. 8, the vertical-load carrying coil 60 is disposed about adjacent loop portions 33 of the linear reinforcing coils 30. Moreover, in contrast with the embodiment shown in FIG. 7, the loops 33 in FIG. 8 are horizontally disposed, i.e., in the plane of the concrete slab 70 whereas the loops 33 in FIG. 7 were vertically disposed, i.e., perpendicular to the plane of the concrete slab 70.

In another aspect of the present invention, after the linear reinforcing coils 30 have been woven, e.g., braided, with synthetic fibers and pre-tensioned, the composite can be coated to physically permeate and encapsulate the composite. Preferably, the coating or sealant 13 can waterproof the composite to prevent oxidation, reduce electrical conductivity, improve alkali resistance, and improve overall strength of the composite.

In a preferred embodiment, the sealant is applied to the composite by pressure treatment or by any application technique known to the art that can penetrate and coat the product thoroughly. Moreover, coatings can be blended to provide a desired degree of flexibility. For use with concrete, a copolymer, e.g., PRIMACOR manufactured by Dow Chemical Company of Midland, Mich., provides a flexible, alkali resistant coating. For use with asphalt, a very-low density polyethylene ("VLDPE"), e.g., FLEXOMER manufactured by Dow Chemical Company, provides a good seal. The invention, however, is not limited to use with the products above.

When operating in a high-temperature, asphalt environment, it is preferred that the VLDPE is blended to have a melting point slightly higher than that of the asphalt mixture. This ensures that the top of the VLDPE is sufficiently softened to provide a better mechanical bond between the asphalt and the VLDPE. Optionally, an ultra-violet ("UV") curing agent can be included with the VLDPE or the alkali-resistant co-polymer to expedite manufacturing and to reduce costs.

In yet another embodiment, the present invention provides a method of reinforcing a construction medium using the aforementioned linear reinforcing coils and vertical load carrying coils. Preferably, in a first step, the method comprises providing one or more linear reinforcing coils at discrete locations to provide multiple levels of reinforcement throughout the depth of the construction medium. Preferably, each of the one or more linear reinforcing coils comprises a plurality of strands of a coil wire interwoven, braided or wrapped with one or more strands of a fiber material. More preferably, the coil wire is a metallic or non-metallic, solid or hollow-core spring or coil wire and the fibrous material is selected from the group consisting of carbon fibers, meso-pitch carbon fibers, fiberglass fibers, polyethylene fibers, aramid fibers, and mixtures thereof. In another aspect of the embodied method, one or more linear reinforcing coils can include one or more load transfer tabs that are disposed at discrete intervals along the length of the linear reinforcing coil.

In a second step, the method comprises providing a plurality of vertical load carrying coils to provide multi-level reinforcement in a vertical direction. Preferably, the vertical load carrying coils are structured and arranged between the linear reinforcing coils to provide reinforcement between the linear reinforcing coils. Preferably, each of the vertical load carrying coils comprises a plurality of strands of a coil portions that have been interwoven, braided or wrapped. More preferably, each coil portion is a metallic or non-metallic, solid or hollow-core spring or coil wire. In another aspect of the embodied method, one or more linear coil portions can include one or more load transfer tabs that are disposed at discrete intervals along the length of the coil portion.

Finally, the method comprises interweaving the plurality of vertical load carrying coils about the multiple levels of linear reinforcing coils.

Figure 9:
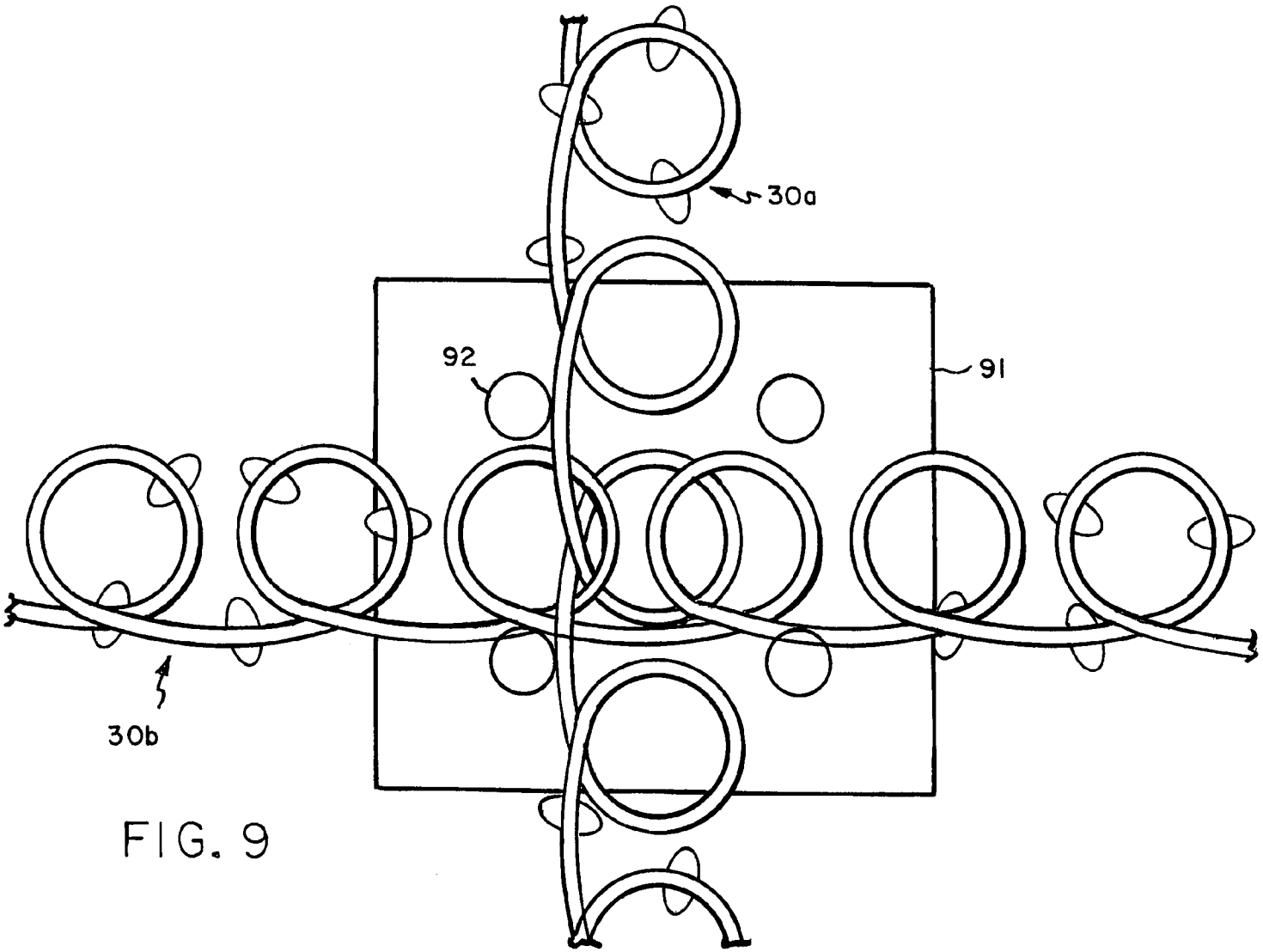
FIG. 9 is an illustrative embodiment of linear reinforcing coils being used in conjunction with anchored coil plates for tunnel wall or shaft reinforcement.

In yet another embodiment, FIG. 9 illustrates use of linear reinforcement coils 30*a* and 30*b* for reinforcing a rock tunnel face or shaft face. Specifically, the linear reinforcement coils 30*a* and 30*b* can be structured and arranged to provide flexible support of potentially unstable rock masses and rock wedges. Preferably, a plurality of linear reinforcing coils 30*a* and 30*b* are structured and arranged at the rock face as necessary to reinforce or support the rock mass to prevent in-fall, e.g., from the tunnel crown or springline. More preferably, at least two linear reinforcement coils 30*a* and 30*b* are anchored to the rock mass of the tunnel face using an anchor plate 91, or coil plate, that is placed on the outer side of the linear reinforcing coils 30*a* and 30*b* and anchored into the rock mass using a plurality of rock anchors 92, e.g., rock bolts, reinforcing bars, wire cable, DYWIDAG® bars (manufactured by Dywidag International of Ascheim, Germany), and the like.

The invention has been described in detail including preferred embodiments thereof. However, modifications and improvements within the scope of this invention will occur to those skilled in the art. The above description is intended to be exemplary only. The scope of this invention is defined only by the following claims and their equivalents.

What I claim is:

1. A device for reinforcing a construction medium having a length, a width, and a depth, the device comprising:

a) one or more linear reinforcing coils, each linear reinforcing coil having one or more load transfer tabs disposed along a length thereof, disposed at one or more depths throughout the depth of the construction medium, at least one of the linear reinforcing coils defining an open loop; and b) one or more vertical load carrying coils that are structured and arranged between linear reinforcing coils when there are multiple levels of linear reinforcing coils in the construction medium to provide additional reinforcement between the multiple levels of linear reinforcing coils, wherein at least one of the vertical load-carrying coils is shaped like a triangular sinusoid, and includes a plurality of peaks and troughs formed by adjacent coil members, wherein the linear reinforcing coils are attached to the vertical load carrying coils at the peaks and troughs, and wherein adjacent coil members cooperate to form an angle β that is about 45°.

2. The device as recited in claim 1, wherein each of the one or more vertical load carrying coils includes a plurality of load transfer tabs that are disposed along a length of the vertical load carrying coils.

3. The device as recited in claim 2, wherein at least one of the load transfer tabs in the device has a shape that is selected from the group consisting of a square, a rectangle, a diamond, a circle, an oval, an ellipse, a triangle, a parallelogram, and a trapezoid.

4. The device as recited in claim 1, wherein each of the one or more linear reinforcing coils comprises a plurality of strands of a coil wire interwoven or braided with one or more strands of a fibrous material.

5. The device as recited in claim 4, wherein the coil wire is a solid or hollow-core spring wire.

6. The device as recited in claim 4, wherein the coil wire is a metal spring wire manufactured of titanium.

7. The device as recited in claim 4, wherein the fiber material is selected from the group consisting of carbon fibers, meso-pitch carbon fibers, fiberglass fibers, polyethylene fibers, aramid fibers, and mixtures thereof.

8. The device as recited in claim 4, wherein the one or more strands of a fibrous material includes excess material at a distal end and a proximal end of the linear reinforcing coil to provide end tab anchors at the distal end and the proximal end.

9. The device as recited in claim 4, wherein the plurality of strands of a coil wire interwoven or braided with one or more strands of a fibrous material is further coated with a coating or sealant to permeate and encapsulate the same.

10. The device as recited in claim 1, wherein the load transfer tabs have a shape and the shape is selected from the group consisting of a square, a rectangle, a diamond, a circle, an oval, an ellipse, a triangle, a parallelogram, a trapezoid, and combinations thereof.

11. The device as recited in claim 1, wherein the construction medium is selected from the group comprising concrete, asphalt cement, gunite, shotcrete, earth slopes, earth embankments, a rock wall of a shaft or tunnel, and combinations thereof.

12. The device as recited in claim 1, wherein at least one of the vertical load carrying coils includes at least one load transfer tab.

13. A system for reinforcing a construction medium having a length, a width, and a depth, the system comprising:

a plurality of linear reinforcing coils, having one or more load transfer tabs disposed along a length thereof, each of the plurality of linear reinforcing coils being disposed at a discrete depth to provide multiple levels of reinforcement in the construction medium, at least one of the linear reinforcing coils defining an open loop; and a plurality of vertical load carrying coils that are structured and arranged between the multi-level linear reinforcing coils to provide additional reinforcement between the linear reinforcing coils, wherein at least one of the vertical load-carrying coils is shaped like a triangular sinusoid, and includes a plurality of peaks and troughs formed by adjacent coil members, wherein the linear reinforcing coils are attached to the vertical load carrying coils at the peaks and troughs, and wherein adjacent coil members cooperate to form an angle β that is about 45°.

14. The system as recited in claim 13, wherein each of the plurality of vertical load carrying coils includes one or more load transfer tabs that are disposed along a length of the vertical load carrying coils.

15. The system as recited in claim 14, wherein at least one of the load transfer tabs in the system has a shape selected from the group consisting of a square, a rectangle, a diamond, a circle, an oval, an ellipse, a triangle, a parallelogram, and a trapezoid.

16. The system as recited in claim 13, wherein each of the one or more linear reinforcing coils comprises a plurality of strands of a coil wire interwoven or braided with one or more strands of a fibrous material.

17. The system as recited in claim 16, wherein the coil wire is a solid or hollow-core coil wire.

18. The system as recited in claim 16, wherein the coil wire is a metal spring wire manufactured of titanium.

19. The system as recited in claim 16, wherein the fibrous material is selected from the group consisting of carbon fibers, meso-pitch carbon fibers, fiberglass fibers, polyethylene fibers, aramid fibers, and mixtures thereof.

20. The system as recited in claim 13, wherein the load transfer tabs have a shape that is selected from the group consisting of square, a rectangle, a diamond, a circle, an oval, an ellipse, a triangle, a parallelogram, a trapezoid, and combinations thereof.

21. The system as recited in claim 13, wherein the construction medium is selected from the group consisting of concrete, asphalt cement, gunite, shotcrete, earth slopes, earth embankments, a rock wall of a shaft or tunnel, and combinations thereof.

22. The system as recited in claim 13, wherein the one or more strands of a fibrous material includes excess material at a distal end and a proximal end of the linear reinforcing coil to provide end tab anchors at the distal and the proximal end.

23. The device as recited in claim 13, wherein the plurality of strands of a coil wire interwoven or braided with one or more strands of a fibrous material are further coated with a coating or sealant to permeate and encapsulate the same.

24. A system for reinforcing a rock tunnel face, the system comprising:

a) a plurality of linear reinforcing coils, having one or more load transfer tabs disposed along a length thereof, each of the plurality of linear reinforcing coils being disposed at a discrete depth to provide multiple levels of reinforcement in the rock tunnel face, at least one of the linear reinforcing coils defining an open loop;

b) a plurality of vertical load carrying coils that are structured and arranged between the multi-level linear reinforcing coils to provide additional reinforcement between the linear reinforcing coils, wherein at least one of the vertical load-carrying coils is shaped like a triangular sinusoid, and includes a plurality of peaks and troughs formed by adjacent coil members, wherein the linear reinforcing coils are attached to the vertical load carrying coils at the peaks and troughs, and wherein adjacent coil members cooperate to form an angle β that is about 45°; and c) an anchor plate for anchoring the plurality of linear reinforcing coils to the rock tunnel face.

25. The system as recited in claim 24, wherein each of the plurality of vertical load carrying coils includes one or more load transfer tabs that are disposed along a length thereof.

26. The system as recited in claim 25, wherein each of the one or more linear reinforcing coils comprises a plurality of strands of a coil wire interwoven or braided with one or more strands of a fiber material.

27. The system as recited in claim 26, wherein the coil wire is a solid or hollow-core coil wire.

28. The system as recited in claim 26, wherein the coil wire is a metal spring wire manufactured of titanium.

29. The system as recited in claim 26, wherein the fibrous material is selected from the group consisting of carbon fibers, meso-pitch carbon fibers, fiberglass fibers, polyethylene fibers, aramid fibers, and mixtures thereof.

30. The system as recited in claim 24, wherein the load transfer tabs include a shape selected from the group consisting of a square, a rectangle, a diamond, a circle, an oval, an ellipse, a triangle, a parallelogram, a trapezoid, and combinations thereof.

* * * * *